US011390434B2

(12) United States Patent
Lowette

(10) Patent No.: US 11,390,434 B2
(45) Date of Patent: Jul. 19, 2022

(54) LID ASSEMBLY FOR A DRINKING CONTAINER

(71) Applicant: BIBO BRANDS BVBA, Hasselt (BE)

(72) Inventor: Stijn Lowette, Hasselt (BE)

(73) Assignee: BIBO BRANDS BVBA, Hasselt (BE)

( * ) Notice: Subject to any disclaimer, the term of this patent is extended or adjusted under 35 U.S.C. 154(b) by 142 days.

(21) Appl. No.: 16/965,728

(22) PCT Filed: Feb. 6, 2019

(86) PCT No.: PCT/EP2019/052935

§ 371 (c)(1),
(2) Date: Jul. 29, 2020

(87) PCT Pub. No.: WO2019/154872

PCT Pub. Date: Aug. 15, 2019

(65) Prior Publication Data

US 2021/0031988 A1 Feb. 4, 2021

(30) Foreign Application Priority Data

Feb. 7, 2018 (WO) ..... PCT/EP2018/053087
Aug. 17, 2018 (BE) ..... 2018/5574

(51) Int. Cl.
*B65D 47/20* (2006.01)
*B65D 53/00* (2006.01)
(Continued)

(52) U.S. Cl.
CPC ..... *B65D 47/20* (2013.01); *A47G 19/2272* (2013.01); *B65D 47/249* (2013.01); *B65D 53/00* (2013.01)

(58) Field of Classification Search
CPC .. B65D 53/00; B65D 47/249; B65D 47/2093; B65D 47/20; B65D 47/06; B65D 43/26;
(Continued)

(56) References Cited

U.S. PATENT DOCUMENTS 4,184,603 A 1/1980 Hamilton, Sr.
2013/0062358 A1 3/2013 El-Saden
(Continued)

FOREIGN PATENT DOCUMENTS

WO WO 2005/115204 A1 * 12/2005 ..... A47G 19/22
WO 2010003259 A1 1/2010

OTHER PUBLICATIONS

ISR-WO for parent application PCT/EP/2019/052936 dated Apr. 15, 2019.
ISR-WO for application PCT/EP/2018/053087 dated Nov. 14, 2018.

*Primary Examiner* — Don M Anderson
*Assistant Examiner* — Madison L Poos
(74) *Attorney, Agent, or Firm* — Vorys, Sater, Seymour and Pease LLP

(57) ABSTRACT

In a first aspect, the current invention concerns a lid assembly for a drinking container, the lid assembly comprising a lid housing having a drinking opening, a sealing assembly comprising a sealing assembly body and a sealing element which is moveable between a first closed position and a second open position, and an operating assembly for operating the sealing assembly to move the sealing element between the first and second positions. In particular, the lid assembly further comprises a mounting member onto which the sealing assembly body is pivotally mounted, about a pivot axis, and wherein the mounting member is releasably connectable to the lid housing. The invention further concerns an interior mechanism for a lid assembly, and a drinking container comprising such a lid assembly.

14 Claims, 10 Drawing Sheets

(51) Int. Cl.
*A47G 19/22* (2006.01)
*B65D 47/24* (2006.01)

(58) Field of Classification Search
CPC .... B65D 43/16; B65D 41/04; B65D 2547/06; A47G 19/2272; A47G 19/2266
USPC ..... 220/288; 215/229, 387–389
See application file for complete search history.

(56) References Cited

U.S. PATENT DOCUMENTS

2015/0060448 A1* 3/2015 Coon ..... A45F 3/18 220/254.1
2015/0201776 A1 7/2015 Elsaden

* cited by examiner

LID ASSEMBLY FOR A DRINKING CONTAINER

TECHNICAL FIELD

The present invention relates to a lid assembly for a drinking container, to interior mechanisms for such lid assemblies, and to a drinking container as such.

BACKGROUND

Drinking containers typically comprise a container body and a lid assembly. The container body, on the one hand, encloses a holding volume for holding a drinking liquid. It thereby features a top opening, via which a drinking liquid can be brought into and/or removed from the holding volume. The lid assembly, on the other hand, can be mounted onto the container body, at its top opening. In doing so, the top opening is covered and drinking liquid is prevented from spilling.

The lid assembly may be a simple cap, screwable onto the top opening of the container body. Other drinking containers, such as commuter mugs, typically comprise a lid assembly that additionally includes a drinking opening (e.g. a drinking hole). The user may then fill the holding volume with a hot or cold drinking liquid (e.g., ice water or coffee) when the lid assembly is removed. In order to drink the liquid, the user then tips the container having the lid assembly mounted thereon, allowing the liquid to pass through the opening. The user may thereby sip the drinking liquid as it exits the opening.

There do exist more advanced lid assemblies, further comprising an interior mechanism for selectively opening and closing the drinking opening. However, with an increased complexity of the lid assembly, it becomes more difficult to properly clean its different components. This is the case for such interior mechanisms in particular. The drinking liquid present in the drinking container may thus be contaminated.

EP 3 214 011 A1, for instance, discloses a lid assembly including a lid housing forming a spout, with a drinking opening extending therethrough. The lid assembly further comprises a displaceable sealing assembly, pivotably coupled to the lid housing. The latter is pivotally displaceable into a cleaning position, in which debris and bacteria may be cleaned from the sealing assembly. However, the sealing assembly remains attached to the lid assembly at all times. This may impede a thorough cleaning. Moreover, the lid assembly has a rather complex design, featuring at least three mutually pivotable parts.

The present invention aims at providing a novel drinking container and/or lid assembly, thereby solving at least some of the abovementioned problems. Special attention is paid to durability, reliability, cleanability, simplicity, and user-friendliness.

SUMMARY OF THE INVENTION

In a first aspect, the invention concerns a lid assembly according to claim 1. The lid assembly comprises a lid housing featuring a drinking opening, a sealing assembly comprising a sealing assembly body and a sealing element, and a mounting member onto which the sealing assembly body is pivotally mounted, about a pivot axis. Latter mounting member is releasably connectable to the lid housing. This may allow for a more thorough cleaning of the interior mechanism of the lid assembly.

In a possible embodiment according to claim 3, the sealing assembly comprises a sealing arm that is slidably mounted onto the sealing assembly body, along a sealing axis. Such a sealing assembly is particularly useful for lid housings that comprise a narrow and/or elongated drinking spout.

In a second aspect, the invention concerns a drinking container that comprises a lid assembly according to the first aspect of the invention.

In a third aspect, the invention concerns an internal mechanism of a lid assembly for a drinking container, according to claim 16. The latter may optionally correspond to the lid assembly according to the first aspect. The same characteristics and advantages may therefore be repeated.

DETAILED DESCRIPTION OF THE INVENTION

Figure 1A:
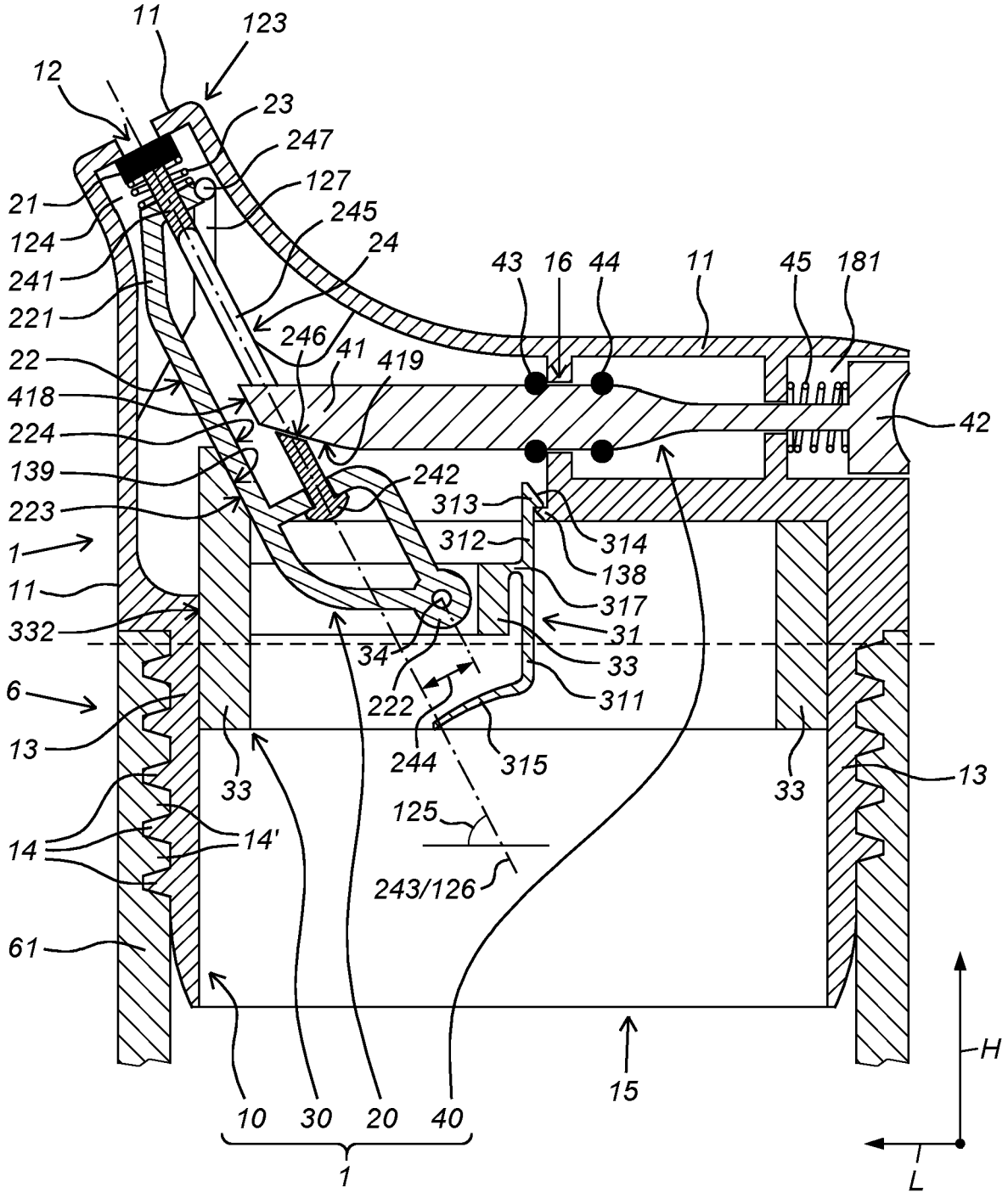
FIGS. 1A-B respectively show a lateral and a transverse cross-section of an embodiment of a lid assembly in its connected configuration, and mounted onto the top opening of a container body.

The present invention concerns a drinking container comprising a container body and a lid assembly, as well as a lid assembly as such.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

As used herein, the following terms have the following meanings:

"A", "an", and "the" as used herein refers to both singular and plural referents unless the context clearly dictates otherwise. By way of example, "a compartment" refers to one or more than one compartment.

"About" as used herein referring to a measurable value such as a parameter, an amount, a temporal duration, and the like, is meant to encompass variations of +/−20% or less, preferably +/−10% or less, more preferably +/−5% or less, even more preferably +/−1% or less, and still more preferably +/−0.1% or less of and from the specified value, in so far such variations are appropriate to perform in the disclosed invention. However, it is to be understood that the value to which the modifier "about" refers is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

The recitation of numerical ranges by endpoints includes all numbers and fractions subsumed within that range, as well as the recited endpoints.

The expression "% by weight", "weight percent", "% wt" or "wt %", here and throughout the description unless otherwise defined, refers to the relative weight of the respective component based on the overall weight of the formulation.

"Releasably connectable", and expressions related thereto are understood to mean being able to be repeatedly connected/disconnected (or engaged/disengaged) with application of human-scale work effort (e.g. through the use of the hands, feet, or human appendage), not generally requiring the use of a tool. Two mutually releasably connectable members can be configured between a "connected configuration" and a "released configuration". In said released configuration, there is no longer a direct connection between the members involved. Preferably, in said released configuration, there is no longer a connection between the members involved. Preferably at least one member of two mutually releasably connectable members provides some operable release mechanism, for releasing the members from their connected configuration. According to some non-limiting embodiments, the releasable connection mechanism comprises a screw coupling (releasable via a turning operation), a bayonet coupling (releasable via a turning operation), and/or a latch coupling (releasable via a pressing operation).

In a first aspect, the invention concerns a lid assembly for a drinking container, the lid assembly comprising:

a lid housing having a drinking opening, a sealing assembly comprising a sealing assembly body and a sealing element which is moveable between a first position, in which the sealing element is positioned such that the drinking opening is closed, and a second position, in which the sealing element is positioned such that the drinking opening is open, and an operating assembly for operating the sealing assembly to move the sealing element between the first and second positions.

In particular, the lid assembly further comprises a mounting member onto which the sealing assembly body is pivotally mounted, about a pivot axis, and wherein the mounting member is releasably connectable to the lid housing. The movement of the sealing element between its first and second positions may correspond to a movement of the sealing element w.r.t. the sealing assembly body. The mounting member may be slidably connected to, and released from the lid housing.

The mounting member (as well as the sealing assembly pivotally mounted thereon) can be released from the lid housing. In doing so, the mounting member and lid housing are brought in their released configuration. This may allow for a more thorough cleaning.

The mounting member may comprise a mounting frame. In their connected configuration, the mounting frame may be received into the lid housing. The mounting frame may be slidingly received into the lid housing. The lid housing may comprise a side wall. According to a possible embodiment, the mounting frame may be received within the side wall of the lid housing via a sliding action, preferably along a mutual height direction. According to a possible embodiment, the mounting frame may be form-fittingly received within the side wall of the lid housing. According to a further embodiment, the mounting frame may be form-correspondingly received within the side wall of the lid housing. The mounting frame may be a circumferential mounting frame, slidingly receivable within a circumferential side wall of the lid housing. A mounting member of this kind provides a sturdy support to the sealing assembly body, at least in the connected configuration.

The mounting frame may comprise one or more support surfaces that provide a snugly fit of the mounting frame within the lid housing. One or more of said support surfaces may be oriented sideways. One or more of said support surfaces may be circumferentially arranged. One or more of said support surfaces may be oriented substantially radially. Optionally, one or more of said support surfaces may be oriented upwards. The mounting frame may be circumferentially received within the lid housing. The mounting frame may provide a circumferential support surface that snugly fits within and against an inner surface of the circumferential side wall. The mounting frame may thereby provide and circumscribe an inner passage for the drinking liquid. The outer size and shape of the mounting frame may substantially correspond to the inner size and shape of the side wall. Latter shapes are preferably not entirely circular. By means of a non-limiting example, latter shapes comprise at least one complementary rib and groove, respectively.

In their released configuration, on the other hand, the mounting member and lid housing can be releasable connected. In doing so, they are brought in their connected configuration. In a possible embodiment, the mounting member and lid housing are releasably connectable by means of one or more resilient elements. Preferably, at least one member of the mounting member and/or lid housing comprises one or more, resilient elements, biased for pressing against the other member. Preferably said resilient elements are operable against the bias, for releasing the mounting member from the lid housing.

In a further or alternative embodiment, the sealing assembly comprises a sealing arm that is moveably mounted onto the sealing assembly body, and that is provided with the sealing element. The sealing arm may have a rotational, translational, and/or a mixed rotational-translational degree of freedom with respect to the sealing assembly body.

Preferably, a first degree of freedom corresponding to the sealing arm being moveably mounted onto the sealing assembly body, substantially allows for moving the sealing element between its first (closed) and second (open) positions. An advantage of the sealing assembly body being pivotally mounted onto the mounting member is that an additional, second degree of freedom is provided. The latter may allow for aligning the sealing element with the drinking opening. This is particularly advantageous in case of an inclined or non-centrally positioned drinking opening.

The second degree of freedom may thereby allow for pivoting the sealing assembly during (a) insertion of the mounting member into, and/or (b) removal of the mounting member out of the lid housing. The sealing assembly body may thus follow a desired path, when displacing the mounting assembly w.r.t. the lid housing, e.g. upon insertion and removal.

Preferably, when moving the sealing element between its first (closed) and second (open) positions, a first degree of freedom of the sealing arm w.r.t. the sealing assembly body is substantially addressed. On the other hand, when connecting/releasing the mounting member to/from the lid housing, a second, pivotal degree of freedom of the sealing assembly body w.r.t. the mounting member is substantially addressed. In a possible embodiment, these first and second degrees of freedom are different in nature. As a consequence, the ease of insertion of the mounting member into the lid housing may be increased. Moreover, the ability of the mounting member to provide a rigid support to the sealing assembly may be increased, in the connected configuration.

In a further or alternative embodiment, the sealing arm is slidably (or telescopically) mounted onto the sealing assembly body, along a sealing axis. The sealing member may be slidably supported and guided by the sealing assembly body. Preferably, latter (first) degree of freedom substantially corresponds to the sealing element being moveable between its first and second positions. Preferably the sealing element, when moving between its first and second positions, substantially travels along said sealing axis. Preferably, the sealing axis substantially extends through a center of the drinking opening. Optionally, the net force acting on the sealing element in its first, closed position (pressing against a drinking opening edge portion) is substantially pointing along the sealing axis.

In a further or alternative embodiment, the lid housing comprises a drinking spout. The drinking opening extends through an upper portion of said drinking spout. Such a design, providing a high or raised user drink interface, allows the drinking opening to be placed near, or to be inserted into a user's mouth without obstruction. The drinking spout may extend along a spout axis, towards the drinking opening. Alternatively, the drinking spout may have a curved design. The drinking spout may enclose a spout channel that connects to said drinking opening.

While such a configuration facilitates drinking, the elongated shape of the spout portion makes sealing the drinking opening difficult. The sealing element is preferably capable of closing off the drinking opening, at or near an upper portion of the drinking spout. Typically, complex mechanisms are required to provide a seal that can be opened and closed by a user, and such complex mechanisms can be expensive to manufacture. In addition, because the mechanisms are disposed within the interior of the lid housing, bacteria and debris may be difficult to remove therefrom.

In a further embodiment, the sealing arm extends into the drinking spout, in the connected configuration of the mounting member and lid housing. The sealing arm may be an elongated member that is slidably/telescopically mounted onto the sealing assembly body, and fitted within the (elongated) drinking spout. The sealing arm may thereby substantially extend along the aforementioned spout axis. An advantage is that such designs are compatible with an elongated and/or narrow drinking spout; preferably the movement of the sealing element between its first and second positions, within the drinking spout, thereby substantially lies along the drinking axis. Preferably the spout axis and the sealing axis are substantially parallel in the connected configuration.

According to a possible embodiment, the sealing arm comprises a sealing portion and an engagement portion. The sealing portion thereby extends into the drinking spout; it is provided with the sealing element for closing the drinking opening at an upper portion of the drinking spout. The engagement end portion, on the other hand, is in connected configuration positioned at or near a lower portion of the drinking spout. As such, it may be more easily accessible for being engaged by the operating assembly. An advantage is that the sliding/telescopic movement of the sealing arm, within a narrow/extended drinking spout can then be controlled at or near a lower portion of the drinking spout.

In a further or alternative embodiment, the lid assembly comprises a guiding means for guiding said sealing arm into and out of said drinking spout. Said guiding means may greatly improve the ease of insertion of the mounting member and sealing assembly into the lid housing. The guiding means may comprise a guide projection and/or a guide slot. The guiding means may act as an alignment means, aligning the sealing element with the drinking opening upon insertion of the mounting member and sealing assembly into the lid housing. Preferably, at least the pivotal degree of freedom of the sealing assembly w.r.t. the mounting member is thereby addressed. More preferably, substantially only the pivotal degree of freedom of the sealing assembly w.r.t. the mounting member is thereby addressed.

When receiving the mounting member and sealing assembly within the lid housing, through a sliding action substantially along their mutual height direction, the sealing element may then naturally align with the drinking opening, through a pivotal movement of the sealing assembly body w.r.t. the mounting member, further guided by said guiding means.

In a non-limiting embodiment, said guiding means are comprised by the sealing arm. Said guiding means may thereby additionally assist in guiding the sealing element between its first (closed) and its second (open) positions, within the spout channel. In particular, the guiding means thereby ensure that the sealing element is not hindered through interference with the spout wall enclosing the spout channel.

It is generally preferred when taking a sip that the spout somewhat runs towards the user of the drinking container.

In a further or alternative embodiment, the drinking spout extends along an inclined spout axis. The inclined spout axis preferably has a spout angle smaller than 90°. The spout angle is preferably between 0° and 89°, preferably smaller than 89°, preferably smaller than 88°, preferably smaller than 87°, and preferably larger than 30°. Even more preferably, the spout angle is substantially smaller than 90°; for instance it is equal to about 60°, about 70°, about 80°, or any value therebetween.

An advantage of the sealing assembly body having a pivotal degree of freedom w.r.t. the mounting member is that, upon connecting these members, the pivot angle may be continuously adjusted. This preferably corresponds to the sealing element advancing into the inclined spout channel. At the same time, the sealing member need not be moved along the exact same direction. For instance, it may be form-fittingly slid into the lid housing, along their mutual height direction. The mounting member can be installed into the lid housing in a straightforward fashion, even for spout angles that are substantially smaller than 90°. Another advantage is that only one design of the interior mechanism (mounting member+sealing assembly) may be suited for cooperating with a number of lid housings featuring different spout angles. This increases its versatility.

In a further or alternative embodiment, the sealing assembly body is pivotable between a first, connected inclination and a second inclination. In its first inclination, the sealing arm preferably extends into the spout channel. In its first inclination, the sealing axis may be substantially parallel to the spout axis. Said second inclination may substantially differ from said first inclination. According to a non-limiting example, said second inclination corresponds to an upward and radially inward inclination of the sealing assembly body. As such, the sealing assembly body is radially more compact. In this radially compact configuration, the internal mechanism (of the mounting member+sealing assembly)

may easily be removed from the lid housing. By way of example, this is further explained in the embodiment of FIG. 2C. Of course, the invention is not limited to the latter.

In a further or alternative embodiment, the sealing assembly body is freely pivotable between the first and second inclinations. Alternatively, a resilient member (e.g. a torsion or compression spring) may be provided, biased for forcing the sealing assembly body in its first or second inclination. This may improve the ease of insertion of the mounting member into the lid housing.

In a further or alternative embodiment, the mounting member comprises an abutment portion for supporting the sealing assembly body in its first, connected inclination. Through this abutment portion, the mounting member may provide support to the sealing arm, (a) against the net sealing force acting on the sealing element and arm when residing in their first closed position, and/or (b) against the net force acting on the sealing element and arm, when operated by means of the operating mechanism.

In a further or alternative embodiment, the sealing axis and the pivot axis are mutually orthogonal. In a further or alternative embodiment, the sealing assembly provides a force lever along the sealing axis, about the pivot axis. A force acting on the sealing arm (e.g. the net sealing force, when the sealing element is in its first position) thereby delivers a moment of force onto said sealing assembly, about said pivot axis. Preferably the sealing assembly is thereby supported against said moment of force by means of the aforementioned abutment surface and/or by means of said guiding means. Operating the operating mechanism then causes the sealing element to move between its first and second positions, while the pivotal movement of the sealing assembly w.r.t. the sealing assembly body is blocked.

In a further or alternative embodiment, the mounting member comprises a circumferential mounting frame, releasably connectable to a side wall of the lid housing. Such a mounting frame may provide a more rigid support to the sealing assembly. Additionally, it may be more easily inserted. In a further or alternative embodiment, the mounting member is releasably connectable to the lid housing by means of one or more resilient elements, biased for gripping a portion of the lid housing. Advantages thereof are mentioned above.

Preferably, the mounting member may comprise two such resilient elements. Said elements may further comprise a contacting portion for pressing against the side wall of the lid housing, when the mounting member is connected to the lid housing. The side wall of the lid housing may further comprise corresponding recesses for receiving latter contacting portions, when the mounting member is connected to the lid housing. Latter contacting portions may further comprise at least one notch, for receiving corresponding protrusions on the side wall of the lid housing, when the mounting member is connected to the lid housing.

In a second aspect, the invention concerns a drinking container comprising a container body, and further comprising a lid assembly as described above. In this regard, the same characteristics and corresponding advantages may be repeated.

In a third aspect, the present invention also provides an interior mechanism comprising a mounting member and sealing assembly, separate from any lid housing and operating assembly. The sealing assembly is mounted onto the mounting member, and the mounting member is suitable for being releasably connected to the lid housing, within the lid housing. In a further embodiment, said interior mechanism has a mounting member and sealing assembly, substantially corresponding to the ones described above. In this regard, the same characteristics and corresponding advantages may be repeated. In particular, the interior mechanism may be connected to, and entirely released from a suitable lid housing. The latter is advantageous for cleaning.

The invention is further described by the following non-limiting examples and figures which further illustrate the invention, and are not intended to, nor should they be interpreted to, limit the scope of the invention.

Figure 1B:
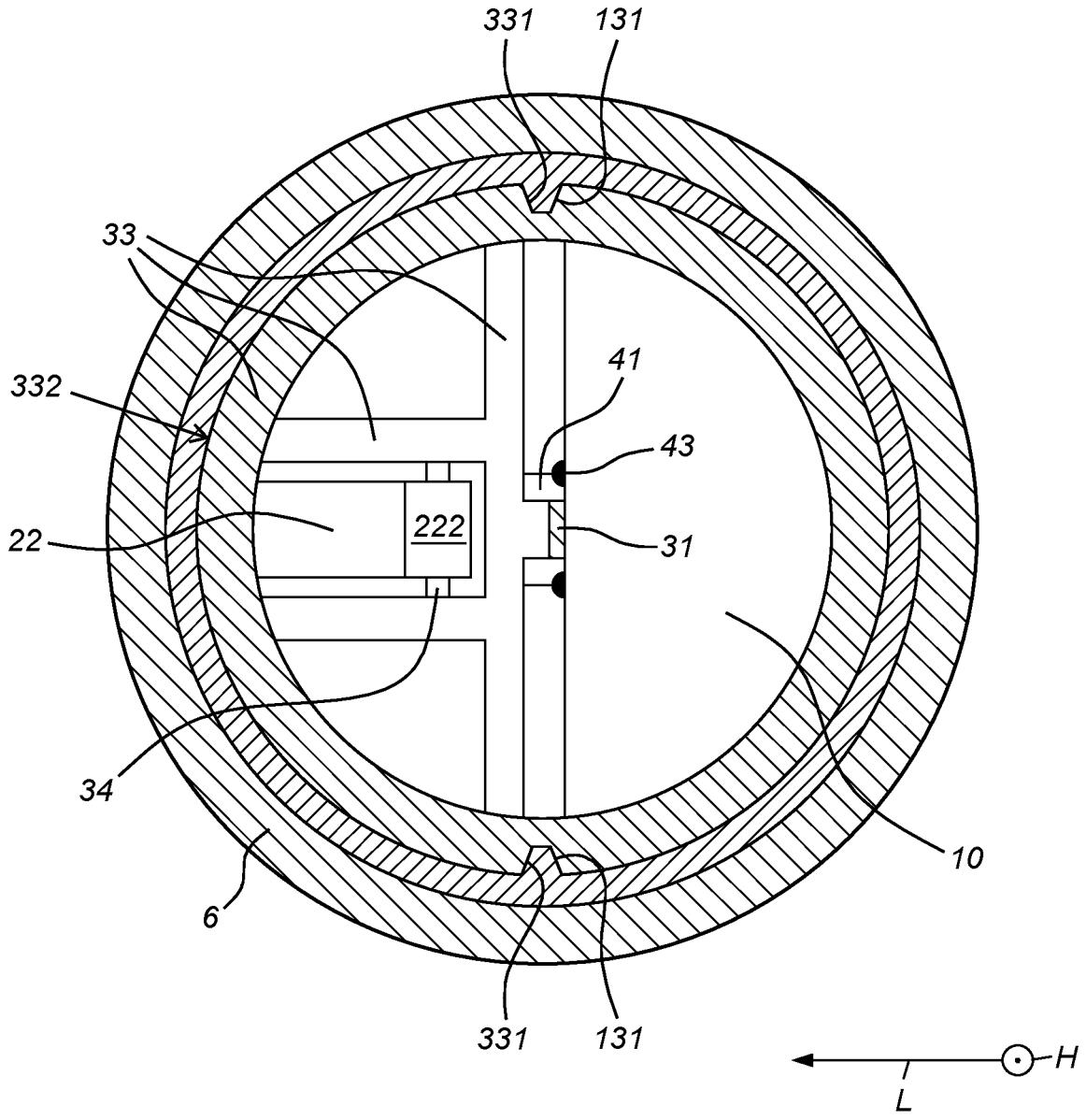
Figure 1C:
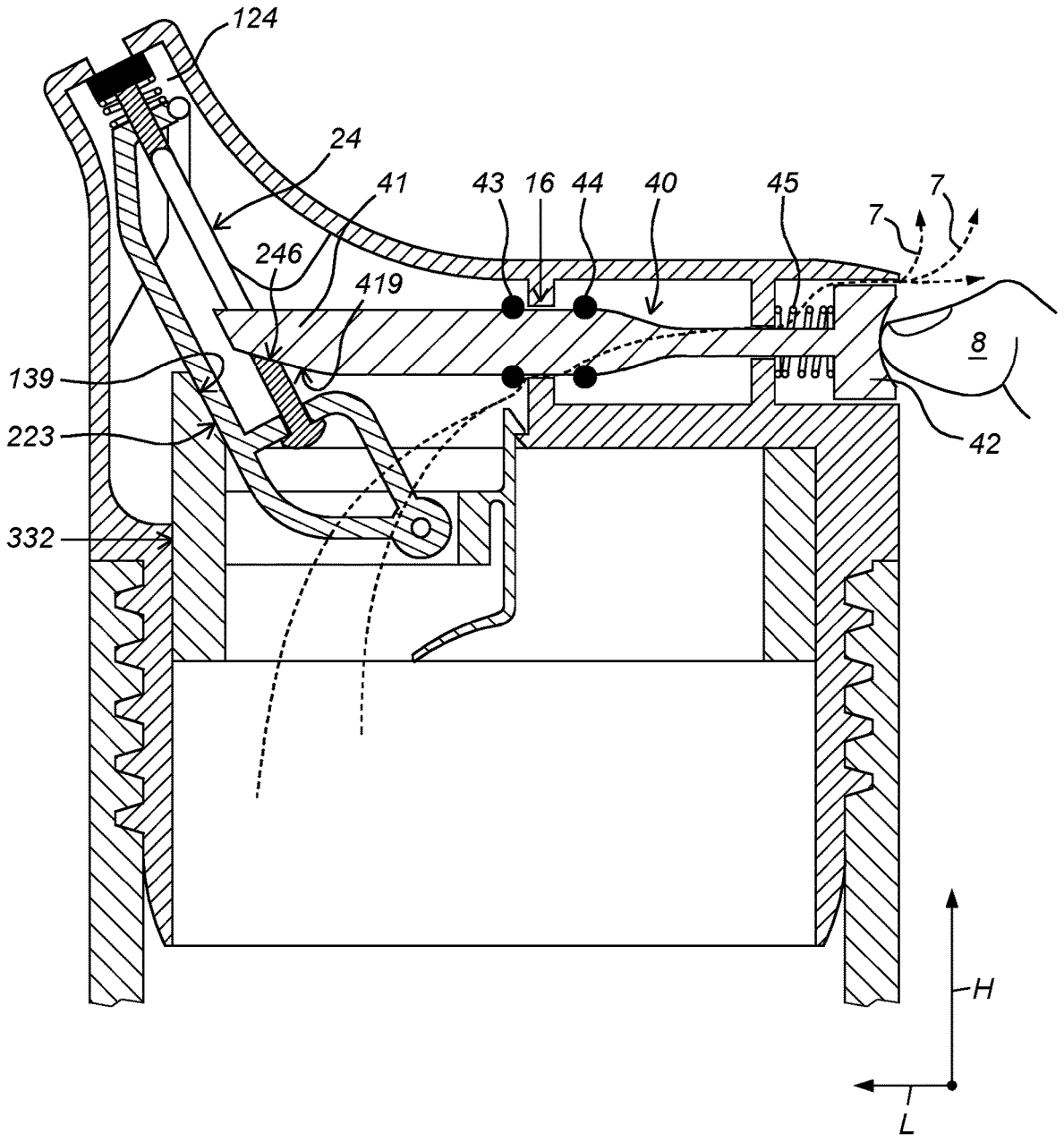
FIGS. 1C-D show lateral cross-sections of the same lid assembly and container body, when operating the operating assembly to move the sealing element.
Figure 1D:
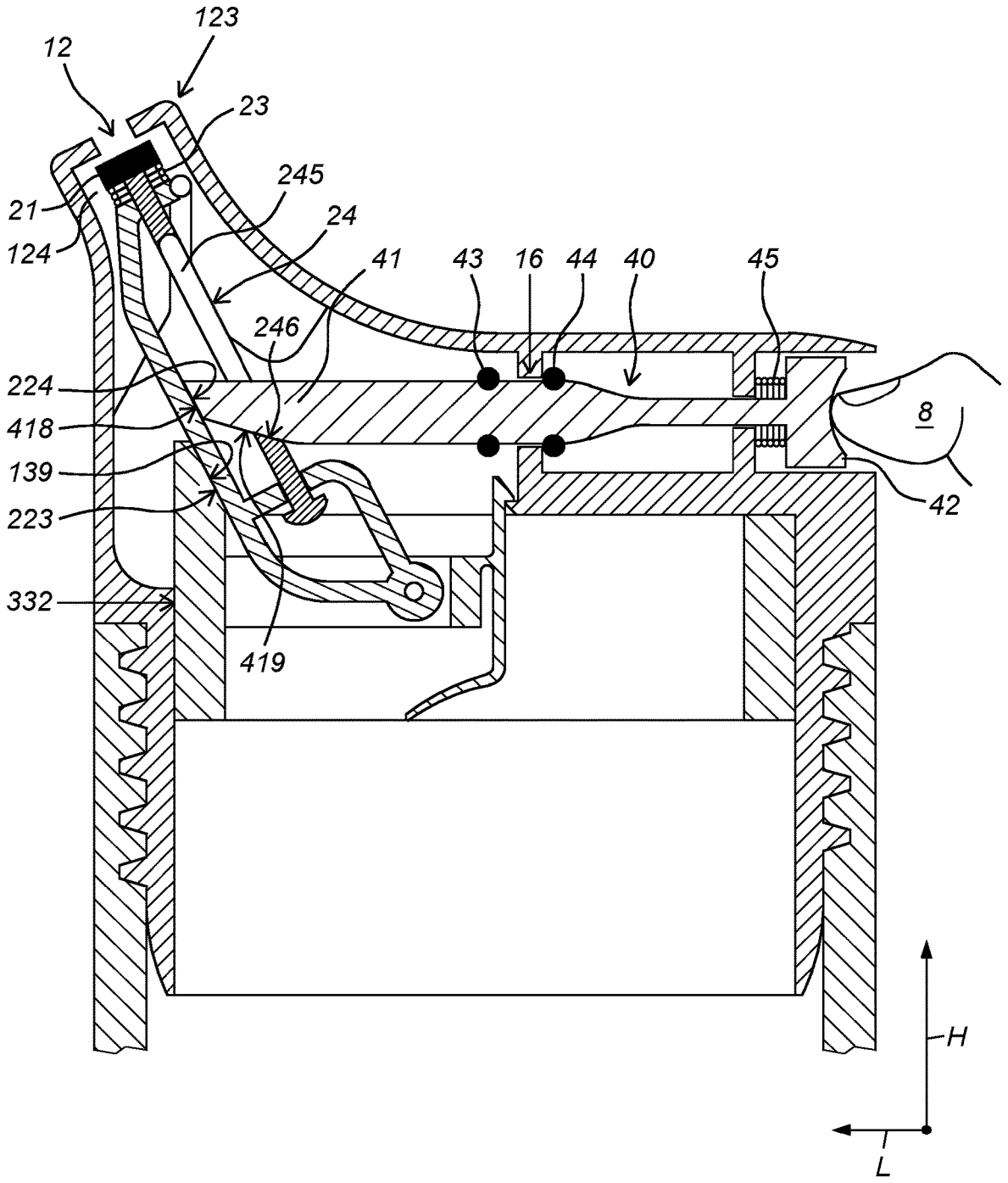
Figure 2A:
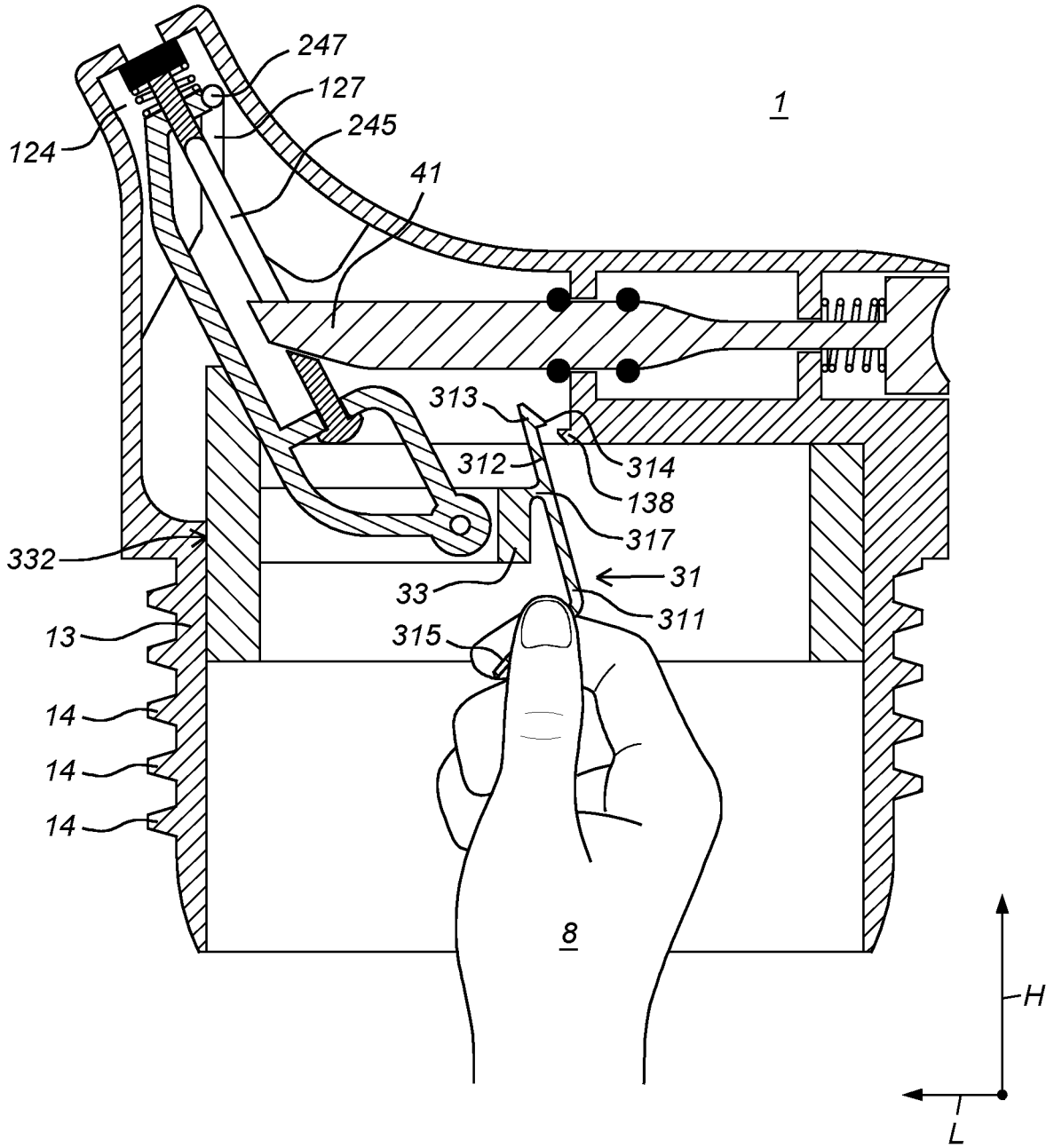
FIGS. 2A-C show lateral cross-sections of the lid assembly, when releasing the releasably connected mounting member from the lid housing.
Figure 2B:
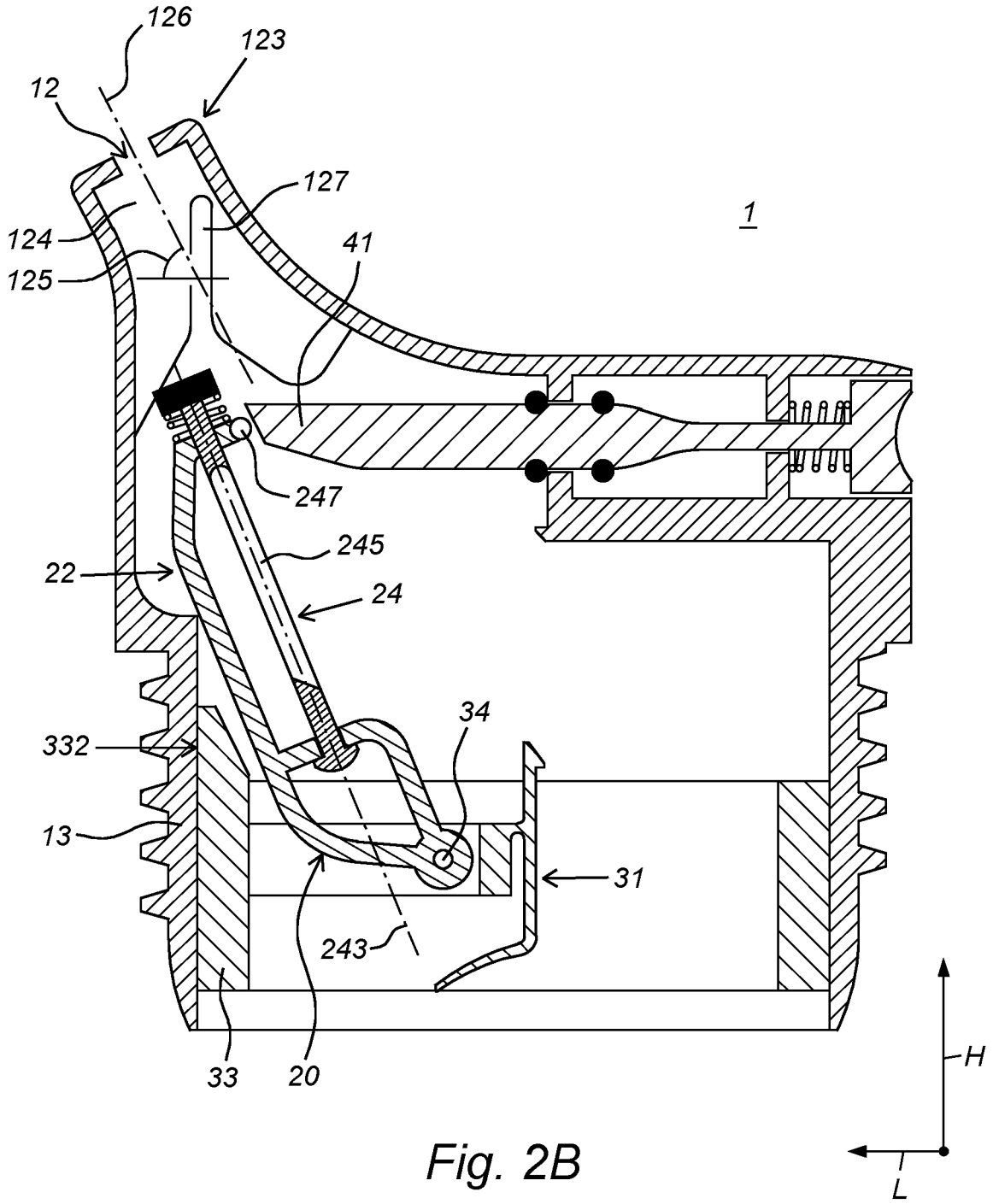
Figure 2C:
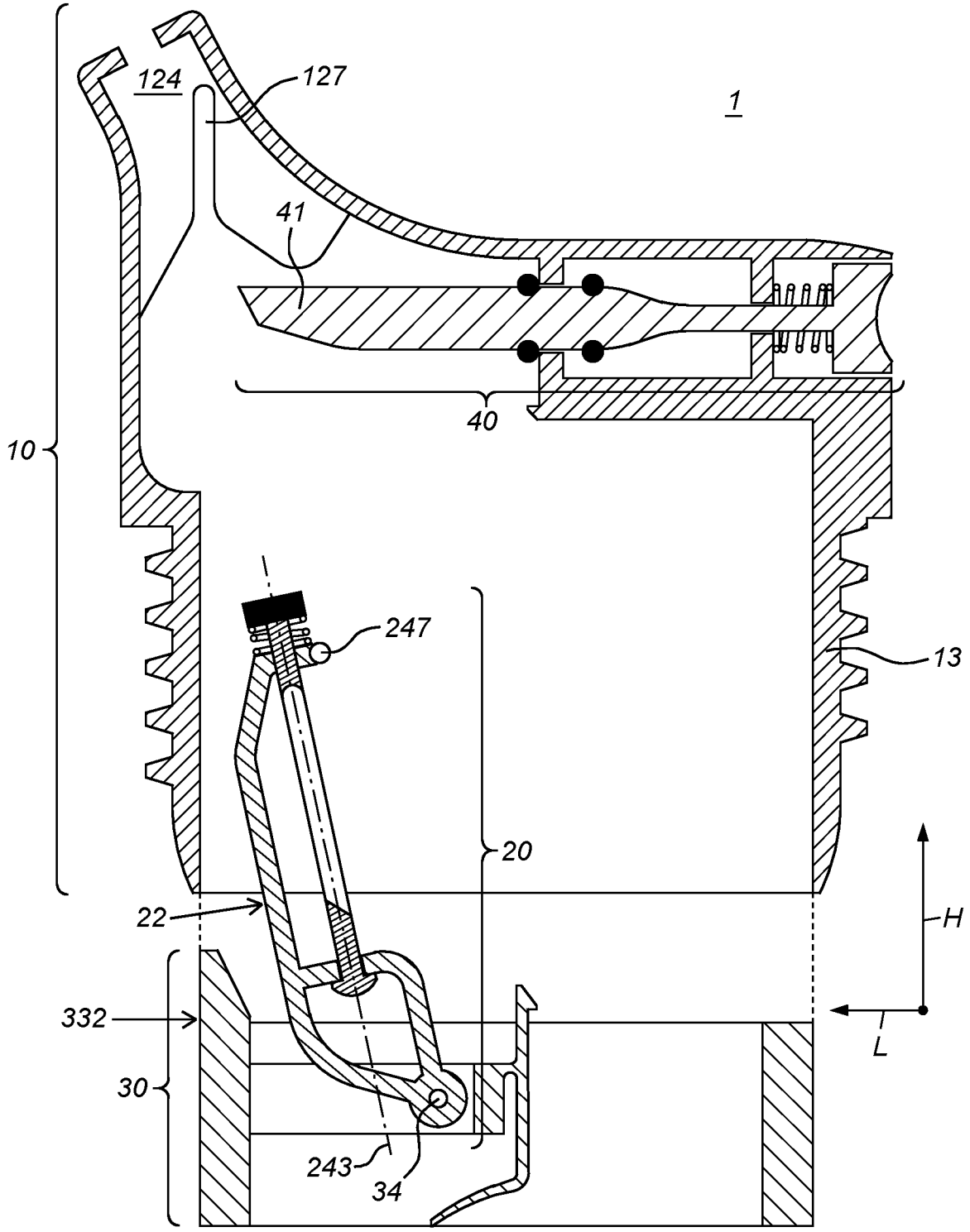

FIGS. 1A-B respectively show a lateral cross-section and a transverse cross-section of an embodiment of a lid assembly 1 in its (releasably) connected configuration, and mounted onto the top opening 61 of a container body 6. FIGS. 1C-D show lateral cross-sections of the same lid assembly 1 and container body 6, when operating the operating assembly 40 to move the sealing element 21 from its first open position into its second closed position. Furthermore, FIGS. 2A-C show lateral cross-sections of the lid assembly 1, when releasing the releasably connected mounting member 30 from the lid housing 10. The lid assembly 1 is thereby brought in its (connectable) released configuration.

The lid assembly 1 comprises a lid housing 10 having an outer surface 11 that bulges radially outward, substantially along an upward inclined spout axis 126, thereby forming a drinking spout 123. In particular, latter spout axis 126 forms a spout angle 125 with respect to the longitudinal direction L, substantially smaller than 90°. And substantially larger than 0°, preferably substantially larger than 45°. A drinking opening 12 thereby extends through an upper portion of the drinking spout 123. Latter drinking opening 12 is orthogonal to the spout axis 126; this is however not necessarily so. A sealing element 21 is further provided, currently positioned such that the drinking opening 21 is closed. However, when moving the sealing element 21 into an open position (e.g. using the operating assembly 40 as described below), the drinking opening 21 may give access to the holding volume of the container body 6, said access running through the spout channel 124, through and/or along the sealing assembly 20 and mounting member 30 (described hereunder), and via the bottom opening 15 of the lid housing 10. In the embodiment shown, the lid housing 10 comprises a downwardly extending side wall 13 that features an external screw thread 14', coacting with an internal screw thread 14 provided at the top opening 61 of the container body 6.

The lid assembly 1 further comprises a sealing assembly 20 having a sealing assembly body 22. The aforementioned sealing element 21 itself is provided onto a sealing arm 24 that is slidably guided and supported by the sealing assembly body 22. A compression spring 23 is further provided, biased for pressing the sealing element 21 against the drinking opening 12, in a first closed position of the sealing element 21. In particular, using the operating assembly 40 described below, the sealing arm 24 may be made to slide w.r.t. the sealing assembly body 22, along a sealing axis 243, and against the opposing force created by the aforementioned compression spring 23. The sealing element 21 is thereby brought into a second open position, as shown in FIG. 1D. Presently, the sealing axis 243 is oriented parallel to the spout axis 126, with the sealing arm 24 extending into the spout channel 124, pointing towards the drinking opening 12.

The lid assembly 1 further comprises an operating assembly 40 for operating the above sealing assembly 20, thereby moving the sealing element 21 between the first closed and second open positions. The operating assembly specifically comprises an actuator element 41, slidably received into the lid housing 10 through at least one actuator opening 16. It can be made to slide along a forward direction which may or may not (presently the case) be inclined with respect to the longitudinal direction L. In particular, the actuator element 41 comprises an actuation portion 419 for contacting and for coacting with an engagement portion 246 present on the sealing arm 24. In its first rest position of FIG. 1A, the actuator element 41 is fully withdrawn into the backward direction. The actuator opening 16 is thereby sealed off by means of a first seal 43. The actuator element 41 is however operable by means of a user operable contacting element, presently embodied by a pushbutton 42, and housed within an operating opening 181. A user 8 pushing the pushbutton 42 may thereby cause the actuator element 41 to be displaced into the forward direction, to a certain degree.

When relatively gently pushing the pushbutton 42, the actuator element 41 may be brought into an intermediate venting position. The first seal 43 thereby loses contact with the actuator opening 16, as shown in FIG. 1C. Consequently, a pressure exhaust channel 7 is formed, such that any pressure difference between the holding volume and its surroundings may be restored. This can be advantageous when traveling by plane (pressure variations due to height differences) or when drinking hot beverages (pressure variations due to vapor pressure increase). Preferably, said pressure exhaust channel 7 runs into a direction substantially radially opposite to the drinking spout 123. Indeed, in order to drink the drinking liquid, the user 8 will tip the drinking container 1, 6 such that he faces the drinking spout 123. The drinking liquid surface then preferably levels such that the pressure exhaust channel 7 entry is no longer immersed in the liquid, as may have been the case for a flat storage of the drinking container 1, 6 into a handbag. Pressure differences may then be restored between gaseous phases inside and outside the container 1, 6. Furthermore, in doing so, the actuation portion 419 does not or only just engage the engagement portion 246 of the sealing arm 24; in any case, the sealing element 21 substantially remains in its closed position.

When further pushing the pushbutton 42, the actuator element 41 may be brought into a second opening position. A second seal 44 thereby contacts the actuator opening 16, cutting off the pressure exhaust channel 7. This is shown in FIG. 1D. Simultaneously, the actuation portion 419 of the actuator element 41 coacts with the engagement portion 246 of the sealing arm 24, such that the sealing arm 24 is withdrawn along the sealing axis 243, away from the sealing opening 12. I.e., the sealing arm 24 is pushed away from the drinking opening 12, by means of the actuator element 41 and its actuation portion 419. The sealing element 21 is thereby brought into its second open position. In particular, the sealing arm 24 comprises a passage 245 through which an actuator end 418 of the actuator element 41 may extend. Within said passage 245, the actuation portion 419 of the actuator element 41 forms downward facing surface. Latter surface, when sliding along and off an upward facing surface (i.e. the engagement portion 246) formed by the sealing arm 24, within the same passage 245, causes the sealing arm 24 to move down. At least one of both surfaces comprises an surface portion that is inclined with respect to the sealing axis 243. Only optionally, the actuator element 41 will in its maximum forward position contact a stop portion 224 of the sealing assembly 20.

The user 8 may now sip the drinking liquid from the drinking container 1, 6 as it exits the drinking opening 12 (e.g. when tipped—not shown). Since any pressure differences have been leveled, prior to actually opening the drinking opening 12, he does not risk drinking liquid of being unexpectedly forced through said drinking opening 12. Another compression spring 45 is further provided, biased for returning the actuator element 41 into its original first position when releasing the pushbutton 42. The sealing element 21 then simultaneously returns to its first, closed position (as shown in FIG. 1A).

The lid assembly 1 further comprises a separate mounting member 30, onto which mounting member 30 the sealing assembly body 22 is pivotally mounted, about a pivot axis 34. In the embodiment shown, the mounting member 30 comprises a circumferential mounting frame 33 that is form-fittingly and form-correspondingly received into the lid housing 10, substantially along its height direction H. To such end, the mounting frame 33 has two grooves 331 that coact with two corresponding ribs 131 comprised by the lid housing 10; see FIG. 1B. The mounting frame 33 thereby comprises a substantially circumferential and upper support surface 332 that tightly abuts the inner surface of the lid housing 10. Moreover, the mounting member 30 is releasably connected to, and releasably locked into the lid housing 10. To such end, the mounting member 30 comprises a resilient element 31 featuring a contacting portion 313 that forms a locking tab 314. Latter locking tab 314 thereby coacts with a locking edge 138 present on the lid housing 10. The resilient element 31 itself is integrally formed with the mounting frame 33, through a thin joint 317 that provides a degree of resilience. It has a first leg 311 extending from the joint 317, towards an operating portion 315, and a second leg 312 extending from the joint 317, towards the aforementioned contacting portion 313.

When pulling the operating portion 315 in a downward direction (e.g. downwardly, substantially along the height direction H), the resilient element 31 may be tilted with respect to the mounting frame 33, about its thin joint 317. In doing so, the locking tab 314 may be unlocked from the locking edge 138, which situation is shown in FIG. 2A. When pulling the operating portion 315 even further, the mounting member 30 (as well as the sealing assembly 20 mounted thereon) may be fittingly lowered within the side wall 13 of the lid housing 10; see FIG. 2B. Ultimately, the mounting member 30 and sealing assembly 20 may be entirely separated from the lid housing 10; see FIG. 2C. In this released configuration of the lid assembly 1, debris and bacteria may be cleaned more thoroughly. Conversely, the mounting member 30 and sealing assembly 20, in a released configuration of the lid assembly 1, may be fittingly inserted in the lid housing 10 via its bottom opening 15. The locking tab 314 may thereby lock into/behind the locking edge 138 of the lid housing 10, by which the lid assembly 1 has been brought back into its connected configuration, also depicted in FIG. 1A.

As mentioned above, the drinking spout 123 substantially extends along an inclined spout axis 126. In the connected configuration, the sealing arm 24 equally extends along this spout axis 126, into the spout channel 124. An advantage of the sealing assembly body 22 being pivotally mounted onto the mounting member 30 is that the corresponding pivot angle 34 can be continuously adjusted upon (a) insertion of the mounting frame 30 into and (b) withdrawal of the mounting frame 30 from the lid housing 10. In particular, as shown in FIG. 1A, the sealing arm 24 is in the connected configuration pivoted such that the sealing axis 243 takes a first, connected inclination, substantially parallel to the spout axis 126. Upon its removal from the lid housing 10 however, the pivot angle is continuously adjusted, thereby taking substantially different inclinations. Indeed, the sealing axis 243 may (naturally or guidedly) take a suitable second inclination for the sealing element 21 to (a) pass through the spout channel 124 (FIG. 2A), (b) get past the actuator end 418 of the actuator element 41 (FIG. 2B), and pass through the bottom opening 15 formed by the side wall 13 of the lid housing 10 (FIG. 2C). In at least a part of its pivoting movement, the sealing assembly body 22 may be guided by a guide projection 247 provided thereon, coacting with a corresponding guide slot 127 formed by the lid housing 10. Yet another advantage of the sealing assembly body 22 being pivotally mounted onto the mounting member 30 is that such an interior mechanism (comprising the mounting member 30 and sealing assembly 20) could cooperate with a plurality of lid housing 10 designs featuring differently-inclined drinking spouts 123. The user 8 may thereby compose an individualized lid assembly 1, through combination of such an interior mechanism 20, 30 with a lid housing 10 of his choice.

The mounting member 30 further comprises an abutment portion 139 for supporting the sealing assembly body 22 in its first, connected inclination; see FIG. 1A. When operating the sealing assembly 20, this abutment portion 139 may provide support to a corresponding abutment portion 223 of the sealing assembly body 22, against the pushing force of the actuator element 41. Secondly, this abutment portion 139 constrains the otherwise free pivotal motion of the sealing assembly body 22 w.r.t. the mounting member 30, thereby facilitating insertion its insertion into the lid housing 10. Thirdly, the sealing axis 243 and pivot axis 34 are orthogonally skew with respect to each other. In particular, these axes 243, 34 feature an offset. The sealing assembly 20 therefore provides a force lever 244 about the pivot axis 34, for forces directed along the sealing axis. A net reaction force acting upon the sealing element 21 will thus cause the sealing assembly body 22 to pivot towards the abutment surface 139. In this "connected inclination" of the sealing assembly body 22, the sealing element 21 is automatically properly aligned with the sealing opening 12. Of course the guiding means 247, 127 may perform similar functions. In particular, (a) they may equally provide support to the sealing assembly body 22 when operating the sealing assembly 20, (b) they may equally guide the sealing element 21 within the drinking spout 123 upon insertion/removal, by limiting and guiding the pivotal motion of the sealing assembly body 22, and (c) they may equally establish and maintain a proper alignment of the sealing element 21 w.r.t. the sealing opening 12, within the drinking spout 123. For the latter, it is not required that the actuator element 41 continuously grips the sealing arm 24, even in its closed position. This enables a two-step operating mechanism as described above, featuring a first rest position, an intermediate venting position, and a second opening position for the actuator element 41. In general, preferably at least one of the abutment portions 139, 223 and guiding means 247, 127 is provided.

The mounting member 30 and sealing assembly 20 may constitute a separate, interior mechanism 20, 30 for lid assemblies 1 of drinking containers 1, 6. A connected configuration of such an interior mechanism 20, 30 and a suitable lid housing 10 is shown in FIG. 1A. A released configuration of the interior mechanism 20, 30 and lid housing 10 is shown in FIG. 2C.

Figure 3A:
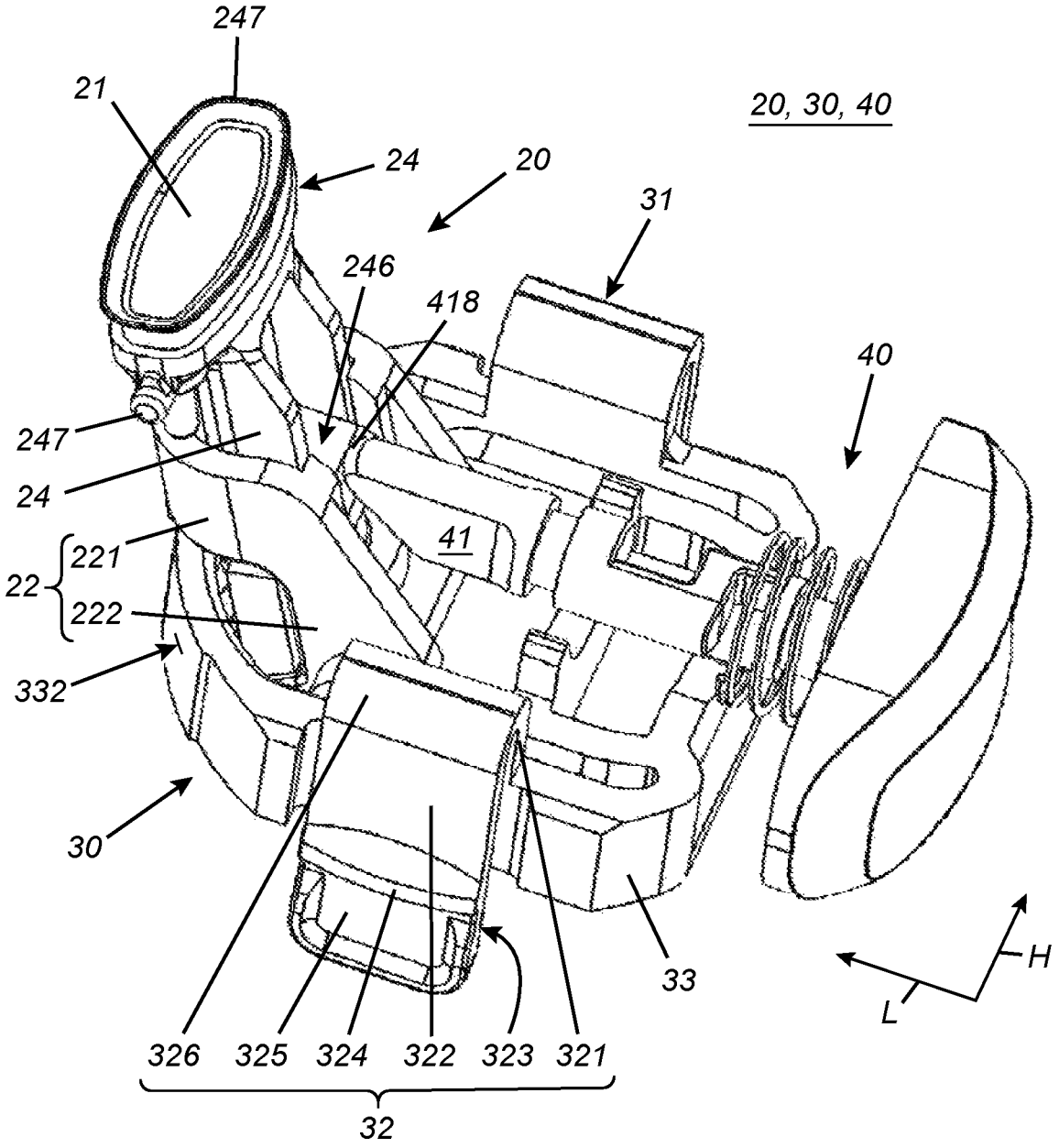
FIGS. 3A-B schematically depict, respectively in perspective and in cross-section, an embodiment of a mounting member and sealing assembly, when co-acting with an operating assembly.
Figure 3B:
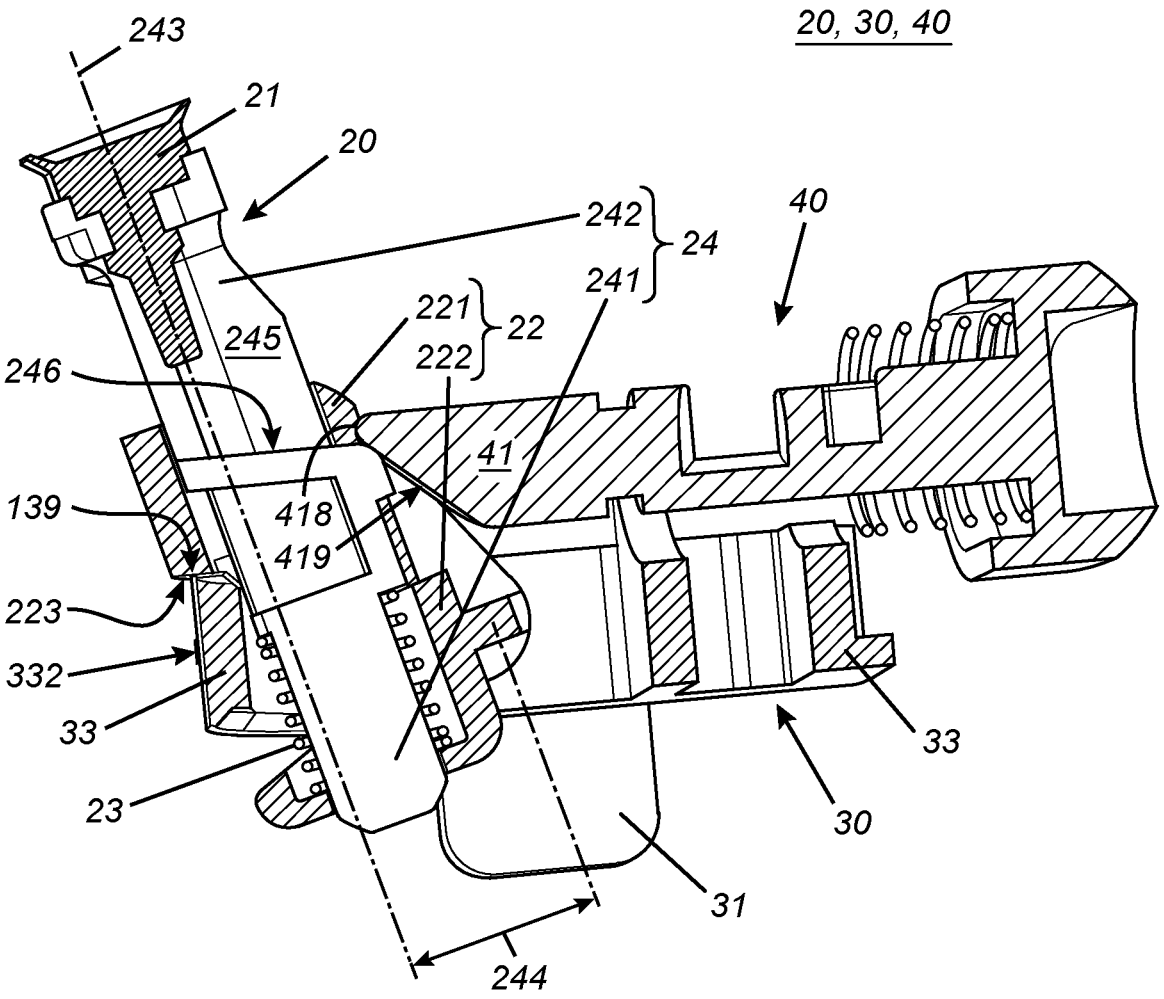
Figure 3C:
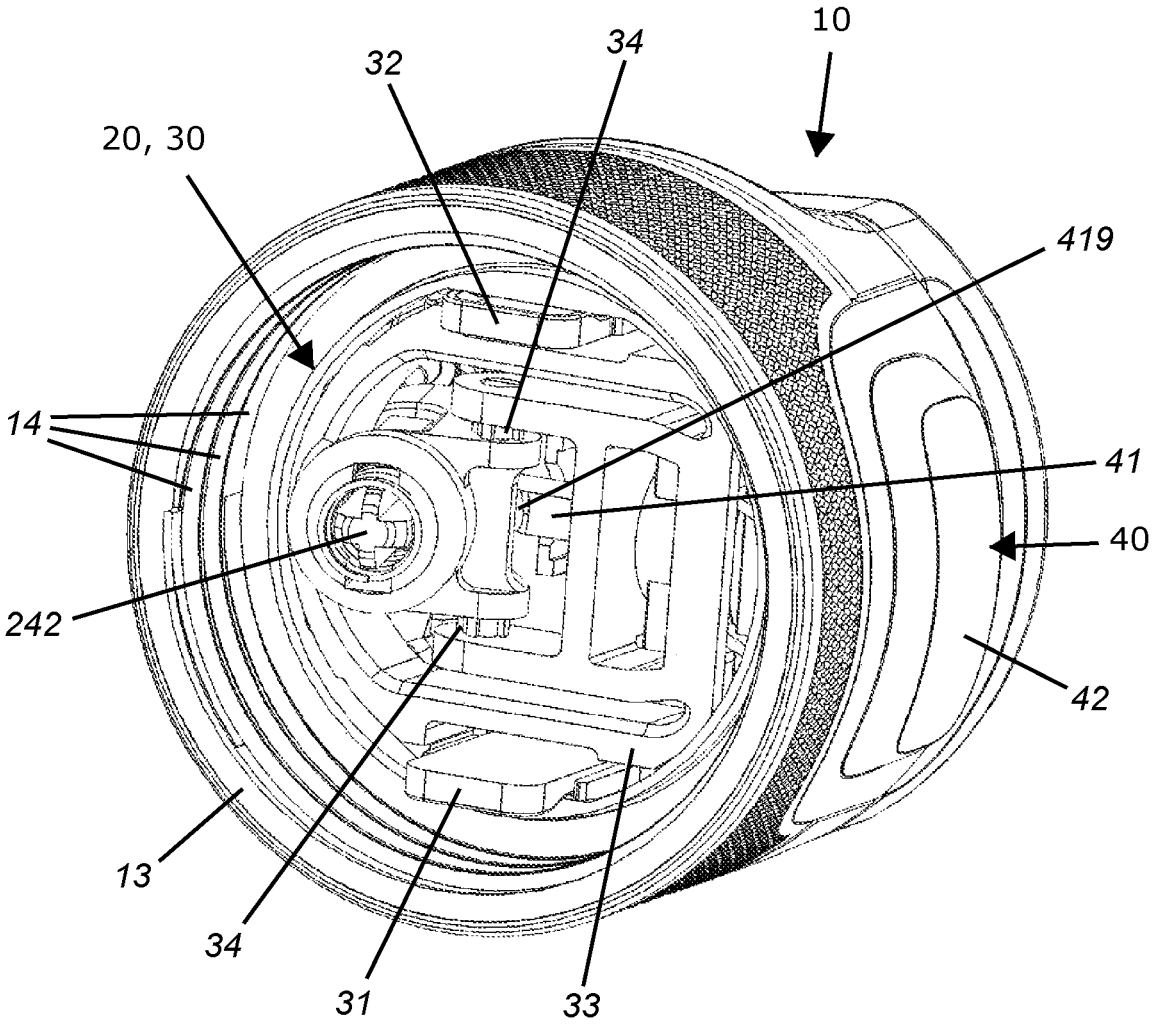
FIG. 3C further shows a perspective view on the same mounting member and sealing assembly, when releasably connected into the bottom opening of a lid housing. The mounting member and sealing assembly thus constitute an internal mechanism for the lid assembly.

FIGS. 3A-B schematically depict, respectively in perspective and in cross-section, another embodiment of a mounting member 30 and sealing assembly 20, when co-acting with an operating assembly 40. The mounting member 30 and sealing assembly 20 may constitute a separate, interior mechanism 20, 30 for lid assemblies 1 of drinking containers 1, 6. FIG. 3C further shows a perspective view on the same mounting member 30 and sealing assembly 20, when releasably connected into the bottom opening 15 of a lid housing 10.

The mounting member 30 is releasably connectable to the lid housing 10 by means of a first resilient element 31 and a second resilient element 32. These are biased for pressing against the side wall 13 of the lid housing 10, thereby connecting the mounting member 30 to the lid housing 10. More specifically, the first resilient element 31 and the second resilient element 32 are arranged for pressing against opposing portions of the side wall 13, and each of the first resilient element 31 and the second resilient element 32 thereby comprises a contacting portion 313, 323 for pressing against the side wall 13 of the lid housing 10. These contacting portions 313, 323 each comprise at least one locking tab 314, 324 for respectively receiving corresponding locking edges on the side wall 13 of the lid housing 10, when the mounting member 30 is connected to the lid housing 10. Moreover, the first resilient element 31 and the second resilient element 32 are operable against bias, for releasing the mounting member 30 from the lid housing 10. To such end, each of the first resilient element 31 and the second resilient element 32 further comprises an operating portion 315, 325. These are moveable towards each other, for releasing the mounting member 30 from the lid housing 10. They can easily be grasped using one hand. The mounting member 30 comprises a circumferential mounting frame 33, on the outside of which the first resilient element 31 and the second resilient element 32 are arranged. The first resilient element 31 and the second resilient element 32 are substantially U-shaped. More specifically, a first leg 311, 321 of the U-shape connects to the mounting frame 33 of the mounting member 30, and goes upwards from the mounting frame 33. A second leg 312, 322 of the U-shape goes downwards from a bent section 316, 326 connecting the first leg 311, 321 and the second leg 321, 322. Latter second leg 321, 322 provides the contacting portion 313, 323. As such, the mounting member 30 can interlockingly engage the side wall 13 of the lid housing 10, enabling for a releasable connection. Preferably, a circumferential and/or upper support surface 332 of the mounting frame 33 thereby tightly abuts the inner surface of said side wall 13.

The sealing assembly 20 comprises a sealing assembly body 22 having a mounting portion 222 and a free portion 221. At its mounting portion 222, the sealing assembly body 22 is pivotally mounted onto the mounting frame 33, about a pivot axis 34. The sealing assembly 20 further comprises a sealing arm 24 having a sliding portion 241, slidably received within the free portion 221 of the sealing assembly body 22. The sealing arm 24 further has a sealing portion 241 onto which the sealing element 21 is provided, and extending from the sliding portion 241, along a sealing axis 243. Latter sealing arm 24 forms a passage 245 for the actuator element 41 of the operating assembly 40, enabling the contact of its actuation portion 419 with an engagement portion 246 of the sealing arm 24. Moreover a compression spring 23 is provided. The latter is biased for exerting a pressure onto the sealing arm 24, along the sealing axis and into its sense of extension. The mounting frame 33 additionally comprises an abutment portion 139 for abutting an abutment portion 223 of the sealing body 22, thereby limiting the free pivotal movement of the latter to a certain range. The sealing axis 243 (passing to a center of the sealing element 21) is offset w.r.t. the pivot axis 34. As a consequence, when exerting a force onto the sealing element 21, along the sealing axis 243 and into its sense of retraction (i.e. opposite to its sense of extension), the sealing assembly 20 provides a force lever 244 with respect to its pivot axis 34. This causes the sealing assembly body 22 to pivot towards the mounting frame 33, abutting an abutment portion 139 of the latter.

EXAMPLE 1—A FURTHER OR ALTERNATIVE EMBODIMENT OF A LID ASSEMBLY

According to a further or alternative embodiment of the invention, the lid assembly 1 comprises a lid housing 10, into which a sealing assembly 20 and mounting member 30 can be releasably connected. The sealing assembly 20 in particular comprises a sealing assembly body 22, pivotably coupled to the mounting member 30, and slidably supporting and guiding a sealing arm 24 that is provided with a sealing element 21. A compression spring 23 is further provided, for biasing the sealing element 21 towards a drinking opening. The lid housing 10 comprises a side wall 13 and a drinking spout 123 having a drinking opening 12. An operating assembly 40 is further provided, for moving the sealing element 21 between a closed and open position. It comprises an actuator element 41 provided with a push button 42, as well as a spring 45 for biasing the actuator element 41 into a fully retracted position. A first 43 and second 44 seal are further provided, similar to the ones described above. The actuator element 41 forms a first recessed portion 411 and a second recessed portion 416, provided on opposite first and second sides with respect to the actuator element 41, and designed for coaction with a locking element. Depending on the position of the locking element, it may either (a) lock the actuator element 41 into its first rest position, when coacting with the first recessed portion 411 (a first protruding portion of the locking element thereby locking into the first recessed portion 411 of the actuator element 41, from a first side w.r.t. the actuator element 41), (b) not interfere with the actuator element 41, or (c) lock the actuator element 41 into its second opening position, when coacting with the second recessed portion 416 (a second protruding portion of the locking element thereby locking into the second recessed portion 411 of the actuator element 41, from the second side w.r.t. the actuator element 41). The first and last situations respectively correspond to a closed and open drinking opening 12. The locking element fits into a locking compartment formed by the lid housing 10. Latter locking compartment, with the locking element provided therein, may be sealed off by means of a cover part. The locking element thereby protrudes through a locking opening in the lid housing 10. The lid housing 10 may further comprise a spout cover for pivotally covering/uncovering the drinking opening 12, and a handle. The lid assembly 1 may further comprise a rubber overmold, for providing an easy grasp. The lid assembly 1 can be mounted onto the top opening 61 of a container body 6, thereby forming a drinking container. A sealing ring may thereby insure a waterproof connection.

The numbered elements in the examples and figures are:

1 lid assembly
10 lid housing
H height direction
11 outer surface
12 drinking opening
123 drinking spout
124 spout channel
125 spout angle
126 spout axis
127 guide slot
13 side wall
131 rib
138 locking edge
139 abutment portion
14 screw thread
15 bottom opening
16 actuator opening
181 operating opening
20 sealing assembly
21 sealing element
22 sealing assembly body
221 free portion
222 mounting portion
223 abutment portion
224 stop portion
23 spring
24 sealing arm
241 sliding portion
242 sealing portion
243 sealing axis
244 lever
245 passage
246 engagement portion
247 guide projection
30 mounting member
31 first resilient element
311 first leg
312 second leg
313 contacting portion
314 locking tab
315 operating portion
316 bent section
317 joint
32 second resilient element
321 first leg
322 second leg
323 contacting portion
324 locking tab
325 operating portion
326 bent section
33 mounting frame
331 groove
332 support surface
34 pivot axis
40 operating assembly
41 actuator element
L longitudinal direction
411 first recessed portion
416 second recessed portion
418 actuator end
419 actuation button
42 push button
43 first seal
44 second seal
45 spring
6 container body
61 top opening
7 pressure exhaust channel
8 user

EXAMPLE 2—MATERIALS OF A LID ASSEMBLY AND INTERIOR MECHANISM

In addition to any of the above, the lid housing may comprise polypropylene (PP), and preferably a HTPP. For instance said housing comprises a HTPP frame, optionally provided externally with a TPE overmold, for enhanced gripping properties. The lid housing may comprise multiple parts that are joined/formed together permanently—for instance via gluing, or via multi component injection molding. The lid housing may thus comprise a HTPP screw part (featuring internal screw thread), joined or formed together with a HTPP cover part. The lid assembly may further be provided with an external handle, for instance comprising acrylonitrile butadiene styrene (ABS). ABS advantageously has a high impact resistance and material toughness. The lid assembly may further be provided with an external spout cover, for covering the drinking opening and drinking spout, in a non-used/stored configuration. The latter may comprise PP, preferably HTPP. A possible locking element (described above) may comprise polyoxymethylene (POM). Advantages are its high stiffness, low friction, and high dimensional stability. This ensures a precise locking by means of said locking element. This also further contributes to the overall durability. The actuator element and user operable contacting element may be formed as one piece, optionally comprising POM. The user operable contacting element may further be provided with an insert that provides a contacting surface. Optionally latter insert comprises a styrene-acrylonitrile (SAN) resin.

Irrespective of the above, the mounting member may have a mounting frame comprising POM. Its high stiffness, low friction and dimensional stability are of particular importance. Indeed, the mounting member may repeatedly be released from, and connected to the lid housing (e.g. for cleaning). Moreover, its connection into the lid housing may depend mostly on the stiffness of some "resilient member", comprised by the mounting member. And in particular on the durability of a locking tab provided thereon. Also the sealing assembly body preferably comprises POM, with similar advantages. The sealing arm may comprise a polyamide, preferably PA66. Advantages are its resistance to wear, and low friction values w.r.t. POM structures.

The sealing element may or may not comprise a silicon. Latter material has a high durability, and is nontoxic. The lid assembly and drinking container may further comprise one or more sealing rings comprising silicon. Any spring members herein may comprise stainless steel, more preferably SS 304. Any container body herein may comprise stainless steel. Preferably such container bodies are double-walled. It is supposed that the present invention is not restricted to any form of realization described previously and that some modifications can be added to the presented example of fabrication without reappraisal of the appended claims.

The invention claimed is:

1. A lid assembly for a drinking container, the lid assembly comprising:

a lid housing having a drinking opening;

a mounting member releasably connectable to the lid housing;

a sealing assembly including:

a sealing assembly body pivotally mounted to the mounting member about a pivot axis;

a sealing arm slidably mounted to the sealing assembly body and movable along a sealing axis; and a sealing element arranged at an end of the sealing arm and moveable along the sealing axis between a first position, in which the sealing element is positioned such that the drinking opening is closed, and a second position, in which the sealing element is positioned such that the drinking opening is open; and an operating assembly for operating the sealing assembly to move the sealing element between the first and second positions.

2. The lid assembly according to claim 1, wherein the lid housing defines a drinking spout through which the drinking opening extends.

3. The lid assembly according to claim 2, wherein the sealing arm extends into the drinking spout.

4. The lid assembly according to claim 2, wherein the lid assembly comprises a guiding means for guiding the sealing arm into and out of the drinking spout.

5. The lid assembly according to claim 2, wherein the drinking spout extends along an inclined spout axis.

6. The lid assembly according to claim 1, wherein the sealing assembly body is pivotable between a first, connected inclination and a second inclination.

7. The lid assembly according to claim 6, wherein the sealing assembly body is freely pivotable between the first and second inclinations.

8. The lid assembly according to claim 6, wherein the mounting member comprises an abutment portion for supporting the sealing assembly body in the first, connected inclination.

9. The lid assembly according to claim 1, wherein the sealing axis and the pivot axis are mutually orthogonal.

10. The lid assembly according to claim 1, wherein the sealing assembly provides a force lever along the sealing axis, about the pivot axis.

11. The lid assembly according to claim 1, wherein the mounting member comprises a circumferential mounting frame releasably connectable to a side wall of the lid housing.

12. The lid assembly according to claim 1, wherein the mounting member is releasably connectable to the lid housing by means of one or more resilient elements biased for gripping a portion of the lid housing.

13. A drinking container comprising a container body and a lid assembly according to claim 1.

14. An interior mechanism for a lid assembly of a drinking container, the interior mechanism comprising:

a mounting member releasably connectable to a lid housing of the lid assembly within an interior of the lid housing; and a sealing assembly including:

a sealing assembly body pivotally mounted to the mounting member;

a sealing arm slidably mounted to the sealing assembly body and movable along a sealing axis; and a sealing element arranged at an end of the sealing arm and moveable with respect to the mounting member between a first, closed position and a second, open position, in which the sealing element is positioned for respectively closing and opening a drinking opening of the lid housing, wherein the sealing assembly is arranged within the interior of the lid housing such that actuating an operating assembly of the lid assembly acts on the sealing arm and thereby causes the sealing element to move between the first and second positions.

* * * * *